US005605199A

United States Patent [19]

Newton

[11] Patent Number: 5,605,199

[45] Date of Patent: Feb. 25, 1997

[54] ELEMENTS FACED WITH SUPER HARD MATERIAL

[75] Inventor: Alex Newton, Clifton, Great Britain

[73] Assignee: Camco Drilling Group Limited, Stonehouse, England

[21] Appl. No.: 493,191

[22] Filed: Jun. 20, 1995

[30] Foreign Application Priority Data

Jun. 24, 1994 [GB] United Kingdom ..... 9412779

[51] Int. Cl.[6] ..... E21B 10/46

[52] U.S. Cl. ..... 175/432

[58] Field of Search ..... 175/420.1, 420.2, 175/426, 428, 432

[56] References Cited

U.S. PATENT DOCUMENTS 5,120,327 6/1992 Dennis .
5,469,927 11/1995 Griffin ..... 175/432
5,486,137 1/1996 Flood et al. ..... 175/432 X

FOREIGN PATENT DOCUMENTS 0389800 10/1990 European Pat. Off. .
0601840 6/1994 European Pat. Off. .
0638383 2/1995 European Pat. Off. .
2283772 11/1994 United Kingdom .

*Primary Examiner*—William P. Neuder

[57] ABSTRACT

A preform element includes a facing table of super hard material having a from face, an outer peripheral surface, and a rear surface bonded to a substrate which is less hard than the super hard material. The facing table comprising a peripheral region surrounding an inner region, the peripheral region having an inner surface which is inclined at an angle of greater than 90° to the rear surface of the facing table so as to face in a direction having a component rearwardly away from the facing table as well as inwardly towards said inner region. The inner region of the facing table may be formed with projections extending into the substrate.

17 Claims, 3 Drawing Sheets

ELEMENTS FACED WITH SUPER HARD MATERIAL

BACKGROUND OF THE INVENTION

The invention relates to elements faced with super hard material, and particularly to preform elements comprising a facing table of super hard material having a front face, a peripheral surface, and a rear surface bonded to a substrate of material which is less hard than the super hard material. Preform elements of this kind are often used as cutting elements on rotary drag-type drill bits and the present invention will be particularly described in relation to such use. However, the invention is not restricted to cutting elements for this particular use, and may relate to preform elements for other purposes. For example, elements faced with super hard material, of the kind referred to, may also be employed in workpiece-shaping tools, high pressure nozzles, wire-drawing dies, bearings and other parts subject to sliding wear, as well as elements subject to percussive loads as may be the case in tappets, cams, cam followers, and similar devices in which a surface of high wear resistance is required.

Preform elements used as cutting elements in rotary drill bits usually have a facing table of polycrystalline diamond, although other super hard materials are available, such as cubic boron nitride. The substrate of less hard material is often formed from cemented tungsten carbide, and the facing table and substrate are bonded together during formation of the element in a high pressure, high temperature forming press. This forming process is well known and will not be described in detail. Each preform cutting element may be mounted on a carrier in the form of a generally cylindrical stud or post received in a socket in the body of the drill bit. The carrier is often formed from cemented tungsten carbide, the surface of the substrate being brazed to a surface on the carder, for example by a process known as "L bonding". Alternatively, the substrate itself may be of sufficient thickness as to provide, in effect, a cylindrical stud which is sufficiently long to be directly received in a socket in the bit body, without being brazed to a carrier. The bit body itself may be machined from metal, usually steel, or may be molded using a powder metallurgy process. Such cutting elements are subjected to extremes of temperature during formation and mounting on the bit body, and are also subjected to high temperatures and heavy loads when the drill is in use down a borehole. It is found that as a result of such conditions spalling and delamination of the super hard facing table can occur, that is to say the separation and loss of the diamond or other super hard material over the cutting surface of the table. This may also occur in preform elements used for other purposes, and particularly where the elements are subjected to repetitive percussive loads, as in tappets and cam mechanisms.

Commonly, in preform elements of the above type the interface between the super hard table and the substrate has usually been flat and planar. However, particularly in cutting elements for drill bits, attempts have been made to improve the bond between the super hard facing table and the substrate by configuring the rear face of the facing table so as to provide a degree of mechanical interlocking between the facing table and substrate.

One such arrangement is shown in U.S. Pat. No. 5120327 where the rear surface of the facing table is integrally formed with a plurality of identical spaced apart parallel ridges of constant depth. The facing table also includes a peripheral ring of greater thickness, the extremities of the parallel ridges intersecting the surrounding ring.

An alternative arrangement is shown in our co-pending British Patent Application No. 9323207.2 where the rear surface of the facing table is integrally formed with a plurality of circumferentially spaced generally radial ribs, the outer extremities of which intersect a peripheral ring extending rearwardly from the rear surface of the facing table.

In such arrangements the peripheral ring is substantially rectangular in cross-section, although the corners may be rounded. Consequently, the inner surface of the peripheral ring extends substantially at 90° to the rear surface of the facing table so as to be generally parallel to, and face towards, the central axis of the cutting element. As a consequence, the inner surface of the peripheral ring meets the rear surface of the facing table at a substantially 90° angle. It is found in practice that such arrangements may result in two serious disadvantages. Firstly, as is well known, the preform element is formed in a high pressure, high temperature press in a process where the substrate is a preformed solid element having a front surface which is pre-shaped to the required configuration. A layer of diamond particles is then packed on to the configured surface of the substrate, filling the recesses therein and forming a continuous facing layer. Pressing of the combined body in the high pressure, high temperature press causes the diamond particles to be bonded together, with diamond-to-diamond bonding, and also bonded to the surface of the substrate, which is usually cemented tungsten carbide. In order to form the rectangular-sectioned peripheral ring on the rear surface of the diamond layer, the substrate is formed with a corresponding rectangular-sectioned peripheral rebate into which the diamond particles are packed.

It is believed that, due to the rectangular shape of the rebate in the substrate, the diamond particles may be less closely packed in the region of the comer of the rebate and less firmly compressed against the cylindrical inner wall of the rebate, resulting in imperfect bonding between the diamond particles and the material of the substrate in this area. Secondly, the 90° junction between the peripheral ring and the rear surface of the facing table forms a stress concentration at this junction. Both of these features, it is believed, can increase the tendency for the facing table to separate from the substrate in use of the cutting element, when it is subjected to substantial temperatures and stresses. It is an object of the invention to provide a new and improved configuration of cutting element where these disadvantages may be overcome.

SUMMARY OF THE INVENTION

According to the invention there is provided a preform element including a facing table of super hard material having a front face, an outer peripheral surface, and a rear surface bonded to a substrate which is less hard than the super hard material, the facing table comprising a peripheral region surrounding an inner region disposed inwardly of said peripheral surface, the peripheral region having an inner surface which is generally inclined at an angle of greater than 90° to the rear surface of the facing table so as to face in a direction having a component rearwardly away from the facing table as well as inwardly towards said inner region thereof.

By inclining the surface of the peripheral region in a direction to face away from the facing table, the bonding of the diamond particles in the peripheral region to the substrate may be improved and, furthermore, inclining the inner surface in this fashion tends to reduce the stress concentration at the junction between the peripheral region and the inner region. Both of these features may reduce the tendency of the facing table to separate from the substrate in use. The inner surface preferably extends at an angle of more than 100° to the rear surface of the facing table, and more preferably at an angle of more than 120°. In a preferred embodiment the inner surface of the peripheral region extends at substantially 135° to the rear surface of the facing table. Said inner surface of the peripheral region may be substantially smooth, although the invention includes within its scope arrangements where the surface is configured, for example is formed with peripheral grooves and/or ridges. The inner surface may be substantially straight as viewed in cross section, so that its overall configuration is generally frusto-conical. The peripheral edge of said inner surface which is furthest from the facing table may lie on the outer peripheral surface of the facing table, or it may be spaced inwardly of said outer peripheral surface, a further annular surface then extending outwardly from the rearmost peripheral edge of said inner surface to the outer peripheral surface of the facing table. Said further annular surface may extend generally parallel to the front surface of the facing table. There may provided an angular junction between the inner peripheral edge of said inner surface and the rear surface of the facing table. Alternatively, the junction between the inner peripheral edge of said inner surface and the rear surface of the facing table may be smoothly curved.

The rear surface of the facing table may be formed with a plurality of integral projections which extend into the substrate. Said projections may comprise a plurality of ribs which extend inwardly from said peripheral region of the facing table and at least partly across said inner region of the facing table. For example, said ribs may be generally radial ribs as described in our co-pending British Patent Application No. 9323207.2. Alternatively, the projections may comprise a plurality of spaced generally parallel ribs extending across the inner region of the facing table, the extremities off set ribs meeting the peripheral region, for example as described in U.S. Pat. No.5120327. In any of the above arrangements a transition layer may be provided between the facing table and the substrate. For example the transition layer may comprise polycrystalline diamond particles embedded in a tungsten carbide matrix.

DETAILED DESCRIPTION OF THE PREFERRED EMBODIMENTS

Figure 1:
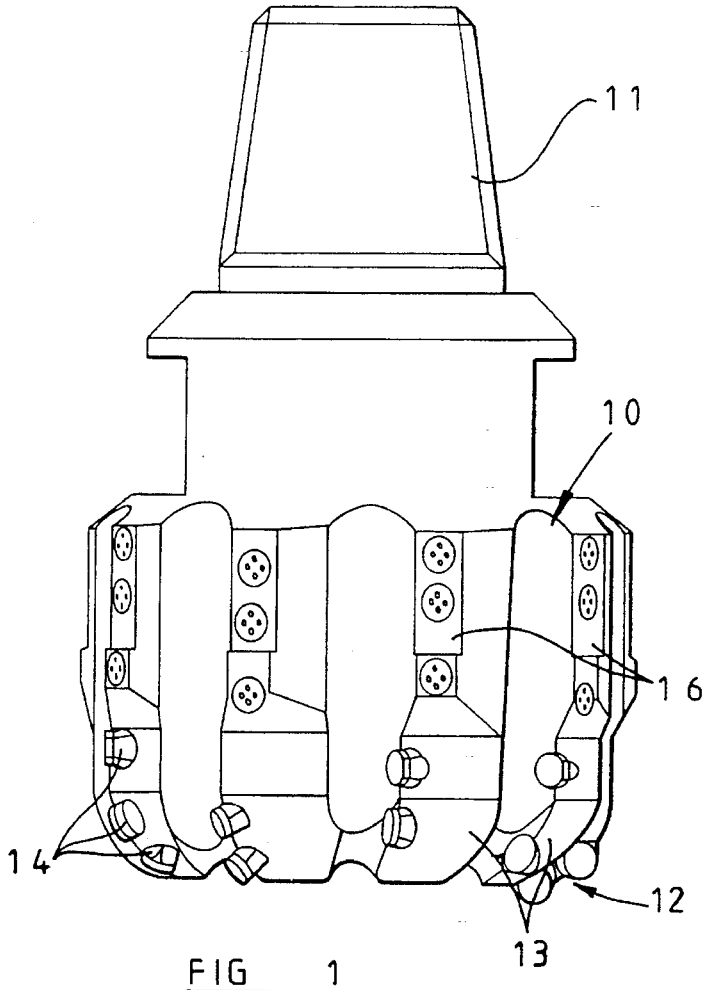
FIG. 1 is a side elevation of a typical drag-type drill bit in which cutting elements according to the present invention may be used.
Figure 2:
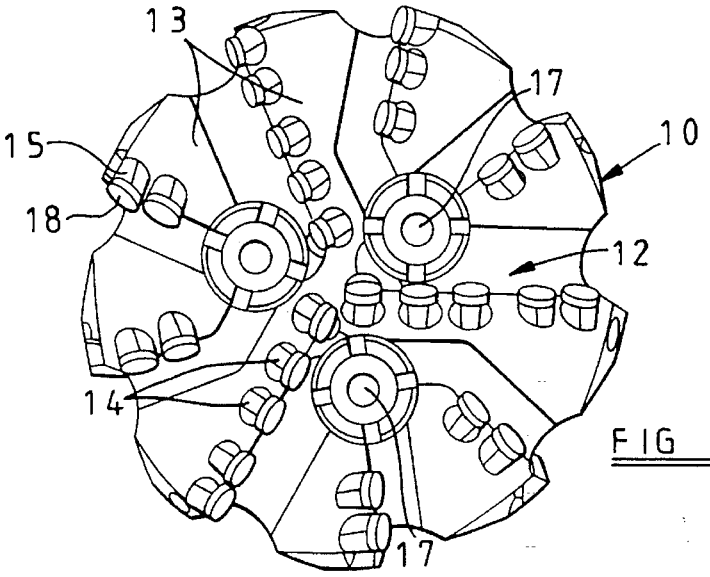
FIG. 2 is an end elevation of the drill bit shown in FIG. 1.

FIGS. 1 and 2 show a typical full bore drag-bit of the kind to which curing elements of the present invention are applicable. The bit body 10 is machined from steel and has a shank formed with an externally threaded tapered pin 11 atone end for connection to the drill string. The operative end face 12 of the bit body is formed with a number of blades 13 radiating from the central area of the bit, and the blades carry cutter assemblies 14 spaced apart along the length thereof. The bit has a gauge section including kickers 16 which contact the walls of the borehole to stabilize the bit in the borehole. A central passage (not shown) in the bit and shank delivers drilling fluid through nozzles 17 in the end face 12 in known manner. Each cutter assembly 14 comprises a preform curing element 18 mounted on a carrier 15 in the form of a post which is located in a socket in the bit body.

Figure 3:
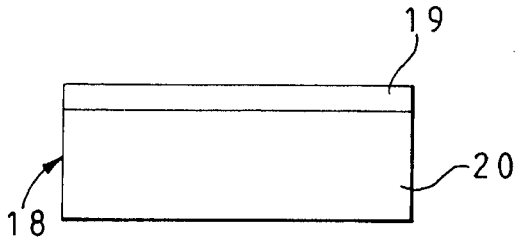
FIG 3 (Prior art)
FIGS. 3–5 are cross-sectional views of three forms of prior art cutting elements.

FIG. 3 shows a common form of prior art preform cutting element. The cutting element 18 is in the form of a circular tablet comprising a facing table 19 of super hard material, usually polycrystalline diamond, bonded to a substrate 20 which is normally of cemented tungsten carbide. The rear surface of the substrate 20 is bonded, for example by L bonding, to a suitably orientated surface on the post 15. For convenience the cutting elements to be described in this specification will be described as being in the form of circular tablets. However, it is to be understood that the invention may be applied to other shapes of cutting element which are in common use. For example a drill bit may incorporate gauge cutters which are in the form of a circular tablet with a segment removed. Other forms of cutter may comprise a sector of a larger circular body, to provide a cutter of a generally "pointed" configuration. As previously mentioned, improvements on the basic preform cutting element of FIG. 3 have been proposed where the rear surface is integrally formed with ribs or other projections which extend into the body of the substrate, the peripheral region of the facing table also being formed with a rearwardly extending peripheral ring of generally rectangular cross section.

Figure 4:
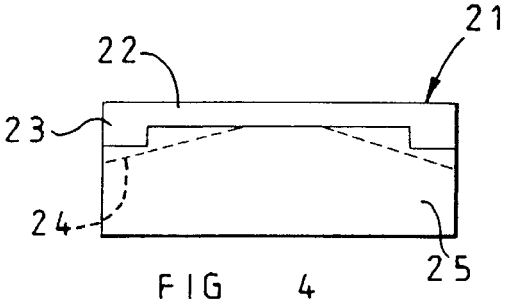
FIG 4 (Prior art)
Figure 5:
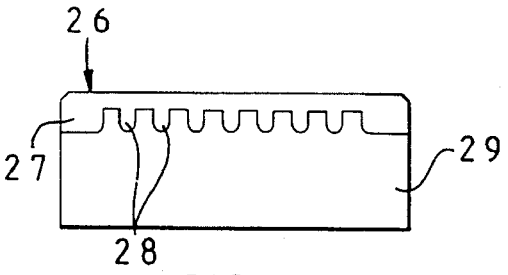
FIG 5 (Prior art)

FIGS. 4 and 5 show two such arrangements. FIG. 4 is a cross sectional view of a form of cutting element described in our co-pending British Patent Application No. 9323207.2. In this case the polycrystalline diamond facing table 21 comprises a generally flat annular inner region 22 surrounded by a peripheral region in the form of a rearwardly projecting peripheral ring 23 of generally rectangular cross section. The rear surface of the facing table 21 is formed with a plurality of circumferentially spaced radial ribs 24 which extend inwardly from the outer periphery of the cutting element and project into the body of the substrate 25. The ribs 24 increase in depth as they extend outwardly and intersect the peripheral ring 23. FIG. 5 shows a curing element which is generally of the kind described in U.S. Pat. No. 5120327. In this case the facing table 26 is formed with a rearwardly extending peripheral ring 27 which is of generally rectangular cross sectional shape, although the inner comer edge of the ring is rounded and the free outer edge is chamfered. The inner region of the facing table 26, within the peripheral ring 27, is formed with a plurality of spaced apart parallel ridges 28 which project into the substrate 29 to lock the facing table to the substrate.

Figure 6:
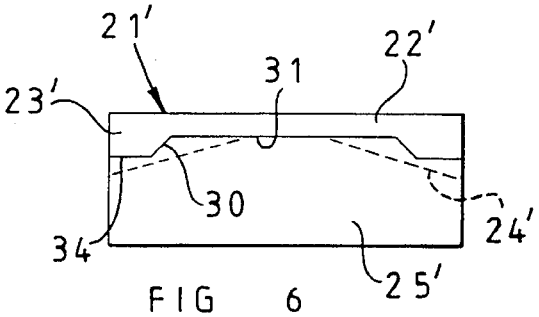
FIGS. 6–10 are similar cross-sectional views of preform cutting elements in accordance with the present invention.

FIG. 6 shows the arrangement of FIG. 4 modified according to the present invention. In this case the inner surface 30 of the peripheral ring 23' is inclined a tan angle greater than 90° to the rear surface 31 of the inner region 22' of the facing table 21', instead of being at right angles to such surface as in the arrangement of FIG. 4. Preferably the surface 30 is disposed at an angle greater than 100° to the surface 31, and more preferably greater than 120° . In a preferred embodiment the surface 30 is inclined at substantially 135° to the surface 31. The rear surface of the facing table 21' is formed with circumferentially spaced radial ribs 24' which extend inwardly from the outer periphery of the cutting element and project into the body of the substrate. The ribs 24" increase in depth as they extend outwardly.

Figure 7:
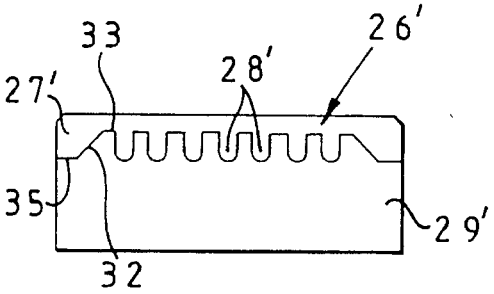

FIG. 7 shows a similar modification to the prior art embodiment of FIG. 5. In this case also the inner surface 32 of the peripheral ring 27' is inclined to the rear surface 33 of the facing table 26' at an angle which is greater than 100°, preferably greater than 120° and in a specific embodiment is 135°. The inner region of the facing table 26', within the peripheral ring 27', is formed with a plurality of spaced apart parallel ridges 28 which project into the substrate 29' to lock the facing table to the substrate. In the embodiments of FIGS. 6 and 7 the lower peripheral edge of the surface 30 or 32 is spaced inwardly from the outer periphery of the cutting element so as to form an annular surface 34 or 35 outwardly of the inclined surface 30 or 32. In alternative embodiments, not shown, the inclined frusto-conical surfaces 30 and 32 are continued outwardly so that their outer and rearward edges lie on the outer peripheral surface of the cutting element. It will be appreciated that in this case the annular surfaces 34 and 35 are omitted.

Figure 8:
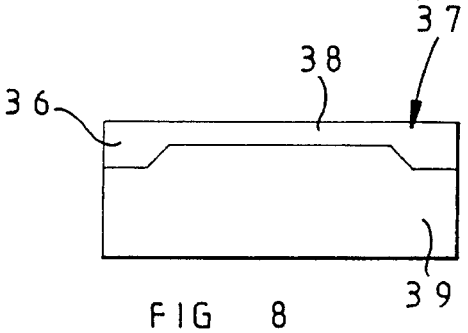

FIGS. 6 and 7 show only examples of the kinds of projections which may integrally formed on the rear surface of the facing table so as to project into the substrate and assist in interlocking the facing table to the substrate. The present invention is not limited to any particular form of such projections, nor to such projections being provided at all. The invention thus also includes within its scope arrangements in which no such projections are provided. For example FIG. 8 shows an embodiment where the peripheral region 36 of the facing table 37 is of similar configuration to the peripheral rings 23' and 27' of FIGS. 6 and 7, but where the inner region 38 of the facing table has a substantially flat rearward surface in engagement with the substrate 39.

Figure 9:
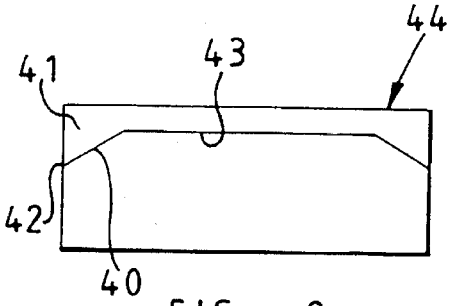

FIG. 9 shows a further modified arrangement where the inwardly and rearwardly facing surface 40 of the peripheral ring 41 is extended so that its outer and rearward edge 42 lies on the external peripheral surface of the cutting element. As in the previously described arrangements the surface 40 is arranged at an angle of greater than 100° to the flat rear surface 43 of the facing table 44 and is preferably at an angle of greater than 120 ° thereto. In the embodiments shown the surface 40 is at an angle of about 135° to the surface 43.

Figure 10:
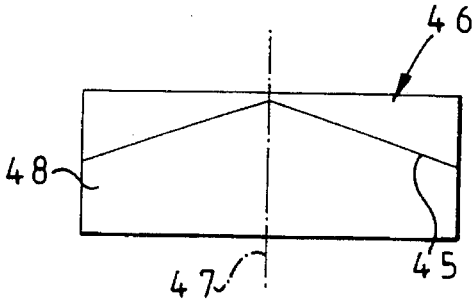

FIG. 10 shows a further modified arrangement in accordance with the invention. In this case the rear surface 45 of the facing table 46 is conical, the thickness of the facing table increasing linearly as it extends from the central axis 47 of the cutting element to the outer periphery. This arrangement may be regarded as a modification of the arrangement of FIG. 9 where the inner region has been reduced in size to a single point lying on the axis of the cutting element. Alternatively, the embodiment of FIG. 10 may be regarded as being a version of FIG. 9 where the rear surface of the inner region of the facing table 46 is formed with a conical depression the angle of which matches the frusto-conical angle of inclination of the peripheral region of the facing table. It will be appreciated that, from this viewpoint, any radial point may be regarded as the junction between the inner region and the peripheral region, and the inner surface of the peripheral region may be regarded as being inclined at 180° to the adjacent surface of the inner region. The embodiment of FIG. 10 may be modified by providing the conical rear surface of the facing table 46 with ribs or other projections to interlock the facing table to the substrate 48.

Figure 11:
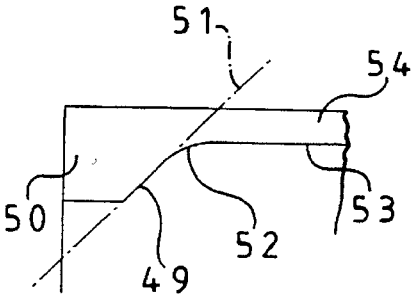
FIGS. 11–13 are pan-sectional views, on an enlarged scale, of preform cutting elements according to the invention, showing further variations in the shape of the peripheral region.
Figure 12:
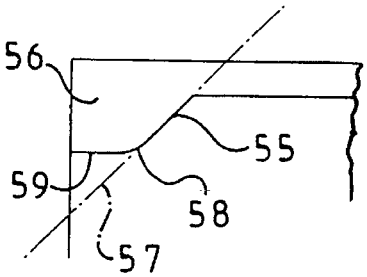

In the previously described embodiments the inwardly and rearwardly facing inclined surface of the peripheral region is straight, as viewed in section, and joins the rear surface of the facing table at an angle. However, neither of these characteristics is essential to the invention which includes within its scope arrangements where the surface is not straight as viewed in section and where it does not intersect the rear surface of the facing table at an angle. Some alternative arrangements are shown, by way of example, in FIGS. 11–13. In FIG. 11 the inclined surface 49 of the peripheral region 50 of the facing table is inclined along a line indicated generally at 51. In this arrangement, however, the inner periphery of the surface 49 extends through a smooth curve, as indicated at 52, so as to run continuously into the rear surface 53 of the inner region 54 of the facing table. In the embodiment of FIG. 12 the inner surface 55 of the peripheral region 56 is similarly inclined, as indicated at 57, but in this case it is the outer edge of the surface 55 which is curved, as indicated at 58, to run smoothly into the annular surface 59 leading to the outer periphery of the cutting element.

Figure 13:
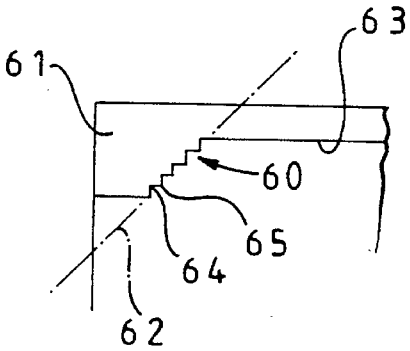

FIG. 13 shows an arrangement in which the inwardly facing surface 60 of the peripheral region 61 is not straight as viewed in section but is stepped, to provide a series of peripheral grooves 64 and ridges 65. In this case the general line of the surface 60, showing its angle of inclination, is indicated at 62 and meets the rear surface 63 of the facing table at angle which is greater than 90°. Any of the features of FIGS. 11–13 may be combined with one another and it will also be appreciated that other cross-sectional shapes of the inclined surface of the peripheral portion of the facing table are possible. In any of the above-described arrangements in accordance with the invention a transition layer may be provided between the facing table and the substrate. The transition layer may, for example, comprise polycrystalline diamond particles embedded in a tungsten carbide matrix.

I claim:

1. A preform element including a facing table of superhard material having a front face, an outer peripheral surface, and a rear surface bonded to a substrate which is less hard than the superhard material, the facing table comprising a peripheral region surrounding an inner region disposed inwardly of said peripheral surface, the peripheral region having an inner surface which is generally inclined at an angle of greater than 90° to the rear surface of the facing table so as to face in a direction having a component rearwardly away from the facing table as well as inwardly towards said inner region thereof, and wherein the peripheral edge of said inner surface which is furthest from the facing table is spaced inwardly of said outer peripheral surface, a further annular surface extending outwardly from the rearmost peripheral edge of said inner surface to the outer peripheral surface of the facing table.

2. A preform element according to claim 1 wherein the inner surface of the peripheral region extends at an angle of more than 100° to the rear surface of the facing table.

3. A preform element according to claim 1, wherein the inner surface of the peripheral region extends at an angle of more than 120° to the rear surface of the facing table.

4. A preform element according to claim 3, wherein the inner surface of the peripheral region extends at an angle of substantially 135° to the rear surface of the facing table.

5. A preform element according to claim 1, wherein said inner surface of the peripheral region is substantially smooth.

6. A preform element according to claim 1, wherein said inner surface of the peripheral region is configured.

7. A preform element according to claim 6, wherein said inner surface of the peripheral region is formed with peripheral grooves and/or ridges.

8. A preform element according to claim 1, wherein the inner surface of the peripheral region is substantially straight as viewed in cross section, so that its overall configuration is generally frusto-conical.

9. A preform element according to claim 1, wherein said further annular surface extends generally parallel to the front surface of the facing table.

10. A preform element according to claim 1, wherein there is provided an angular junction between the inner peripheral edge of said inner surface and the rear surface of the facing table.

11. A preform element according to claim 1, wherein the junction between the inner peripheral edge of said inner surface and the rear surface of the facing table is smoothly curved.

12. A preform element according to claim 1, wherein said projections comprise a plurality of spaced generally parallel ribs extending across the inner region of the facing table, the extremities of said ribs meeting the peripheral region.

13. A preform element according to claim 1, wherein a transition layer is provided between the facing table and the substrate.

14. A preform element according to claim 13, wherein the transition layer comprises polycrystalline diamond particles embedded in a tungsten carbide matrix.

15. A preform element including a facing table of superhard material having a front face, an outer peripheral surface, and a rear surface bonded to a substrate which is less hard than the superhard material, the facing table comprising a peripheral region surrounding an inner region disposed inwardly of said peripheral surface, the peripheral region having an inner surface which is generally inclined at an angle of greater than 90° to the rear surface of the facing table so as to face in a direction having a component rearwardly away from the facing table as well as inwardly towards said inner region thereof, and the rear surface of the facing table being formed with a plurality of integral projections which extend into the substrate.

16. A preform element according to claim 15, wherein said projections comprise a plurality of ribs which extend inwardly from said peripheral region of the facing table I and at least partly across said inner region of the facing table.

17. A preform element according to claim 16, wherein said ribs extend in substantially radial directions.

* * * * *